US006393642B1

(12) United States Patent
Pollman et al.

(10) Patent No.: US 6,393,642 B1
(45) **Date of Patent: *May 28, 2002**

(54) SUPPORTING DEVICE SUCH AS FOR INSTANCE A CUSHION

(75) Inventors: Huibert Paul Pollman; Max Paul Rogmans, both of Haarlem (NL)

(73) Assignee: Vicair B.V., Haarlem (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,694

(22) PCT Filed: Mar. 14, 1996

(86) PCT No.: PCT/NL96/00113

§ 371 (c)(1),
(2), (4) Date: Sep. 11, 1997

(87) PCT Pub. No.: WO96/28073

PCT Pub. Date: Sep. 19, 1996

(30) Foreign Application Priority Data

Mar. 14, 1995 (NL) ..... 9500509

(51) Int. Cl.[7] ..... A47C 7/02

(52) U.S. Cl. ..... 5/706; 5/644; 5/654; 5/702; 5/911

(58) Field of Search ..... 5/706, 654, 689, 5/911, 912, 707; 128/89 R, 870; 297/452.17

(56) References Cited

U.S. PATENT DOCUMENTS

| | | | | | |
|---|---|---|---|---|---|
| 74,340 | A | * | 2/1868 | Gilbert | 5/707 |
| 4,011,611 | A | * | 3/1977 | Lederman | 5/911 |
| 4,027,888 | A | * | 6/1977 | Wilcox | 5/911 |
| 4,885,811 | A | * | 12/1989 | Hayes | 5/911 |
| 5,079,787 | A | | 1/1992 | Pollman | 5/450 |

FOREIGN PATENT DOCUMENTS

| | | |
|---|---|---|
| EP | 0 200 822 A1 | 11/1986 |
| EP | 0 421 540 | 4/1991 |
| GB | 1170449 | 11/1969 |

* cited by examiner

*Primary Examiner*—Terry Lee Melius
*Assistant Examiner*—Fredrick Conley
(74) *Attorney, Agent, or Firm*—Kinney & Lange P.A.

(57) ABSTRACT

A supporting device (1) such as, for instance, a cushion, comprising a space (3) formed by a flexible envelope (2) and filled with a plurality of elements (4). The elements (4) in the space (3) are movable relative to each other and each consist of a gas-filled, flexible and thin-walled covering of gastight design, so that the elements are deformable for distributing a load over the supporting device. The covering of a number of elements is manufactured from at least substantially nonelastic material. These elements are each filled with the gas for 50–98 percent of their maximum volume and have a volume of from 10 $cm^3$ to 100 $cm^3$.

22 Claims, 6 Drawing Sheets

SUPPORTING DEVICE SUCH AS FOR INSTANCE A CUSHION

The invention relates to a supporting device such as, for instance, a cushion comprising a space formed by a flexible envelope and filled with a plurality of elements, the elements in the space being movable relative to each other and each element consisting of a gas-filled, flexible and thin-walled covering of gastight design, so that the elements are deformable and accordingly provide the distribution of a pressure over the supporting device.

Such a supporting device is described in European patent 0200822. The gas-filled elements described in this European patent have dimensions of between 5 microns and 50 mm. A problem occurring with this supporting device is that if the supporting device is for instance used as a seat cushion, insufficient regard is paid to the fact that the pressure or force exerted by a human body on the supporting device is too slight to realize an optimum adaptation of the contents of the supporting device to the body contour. As a consequence, on the basis of insufficient form adaptation, the pressure distribution over the supporting device is not optimal, as a consequence of which such a supporting device, after long use, offers less comfort to a user and may even give rise to bodily complaints.

Apart from the supporting device described in European patent 200822, many supporting methods have meanwhile been conceived and marketed, based on the support by means of air and controlled by means of all types of pump systems, whether or not in combination with segmentation. These methods relate at least substantially to mattresses only.

The drawback of this is, in general, a reduction of pressure-distributing capacity. Besides, such supporting devices have the drawback that they usually have to be individually adjusted to the relevant user. In addition to becoming leaky, such a supporting device is rather liable to be damaged on account of the electric equipment that is typically used. Moreover, the problem of the instability and hence lack of comfort is still present and, furthermore, a vibrating pump may cause an additional discomfort. In particular within the medical care, the increase of the ageing population has resulted in a growing need for simple, lightweight, comfortable and high-quality cushions and mattresses and other supporting devices with a high degree of operational reliability. The need for operational reliability plays an extra great part in, in particular, the likewise growing home care. In addition, sitting occupies a greater and greater part of our lives, and in situations wherein people are sitting for a longer time (office, stadium, plane, car) there is also a need for a supporting device of the type described in the preamble which does not comprise the above drawbacks. Provided that it is designed in accordance with the invention, such a supporting device will provide a better support and, accordingly, more comfort than a supporting device consisting of foam or another nondynamic supporting medium.

The invention meets this need and has as a characteristic that the covering of a number of elements is manufactured from at least substantially nonelastic material, each of these elements being filled with the gas for 50–98 percent of its maximum volume and having a volume of from 10 $cm^3$ to 100 $cm^3$.

As, in accordance with the invention, the elements are filled with the gas for 50–98 percent of their maximum volume, it is provided that the elements can deform individually and thus provide an additional shape-adaptability of the supporting device under slight load. In addition, this degree of filling together with the volume taken up by the elements involves that the elements can move along one another relatively easily, also when the supporting device is loaded. It is thus provided that when the supporting device is loaded, the elements can reposition relative to each other relatively easily. With this, a supporting device obtains as it were an additional degree of freedom for reacting to a load. Moreover, it is provided that as a consequence of the repositioning of the various elements relative to each other, an optimum pressure distribution along and shape adaptation to the body contour of a user of the supporting device is realized.

In accordance with a specific embodiment, a lubricant is present in the envelope, between the elements, for facilitating a movement of the elements relative to each other caused by a load on the supporting device.

In accordance with another aspect of the invention, which provides a solution to the above-outlined problems, a supporting device of the type described in the preamble, there being further present in the space between the elements a lubricant for facilitating a redistribution of the elements in the space through relative movement in the envelope in reaction to a load on the supporting device, is further characterized in that in the space between the elements a free amount of gas is present, so that a minimum amount of lubricant is present, with the gas facilitating a form restoration of the supporting device after the removal of a load on the supporting device. More in particular, the supporting device comprises means for decreasing the amount of gas in the space in the case of a load on the supporting device and for increasing the amount of gas upon the removal of a load on the supporting device without involving a variation of the amount of lubricant in the supporting device.

Hereinafter, the invention will be specified with reference to the accompanying drawings, wherein:

FIG. 1 shows a section of a first embodiment of a supporting device in the form of a cushion according to the invention;

FIG. 2*a* shows a section of an element of the supporting device according to FIG. 1;

FIG. 2*b* is a top plan view of an element in the direction of arrow P according to FIG. 2*a;*

Figure 9A:
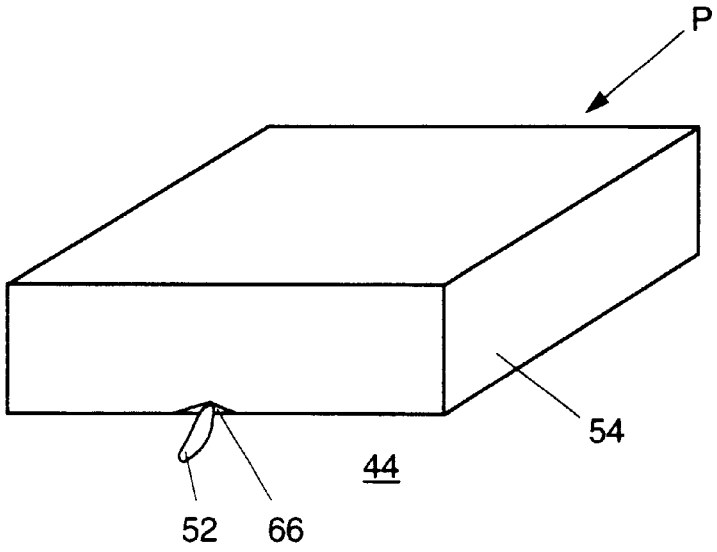
Figure 9B:
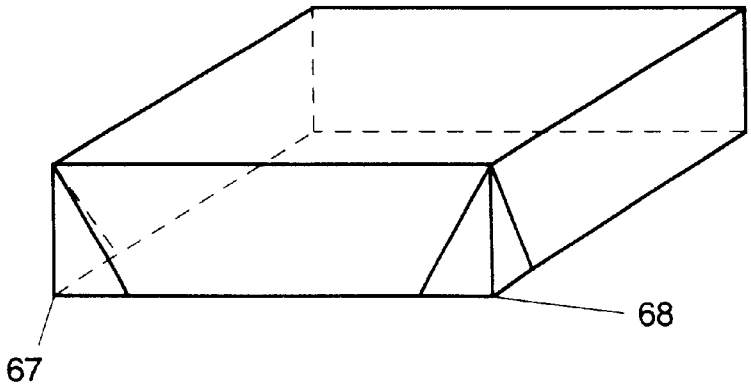
Figure 10A:
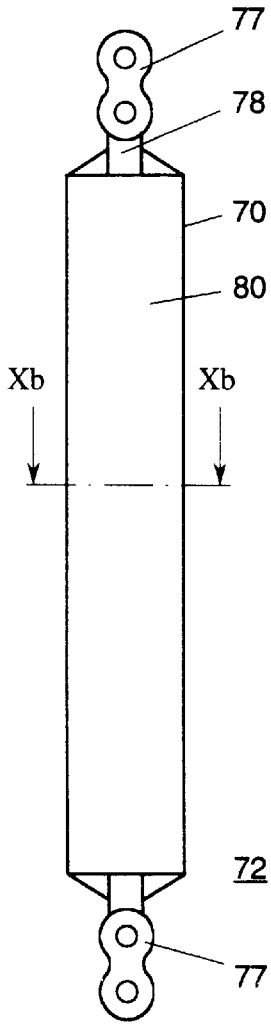
Figure 10B:
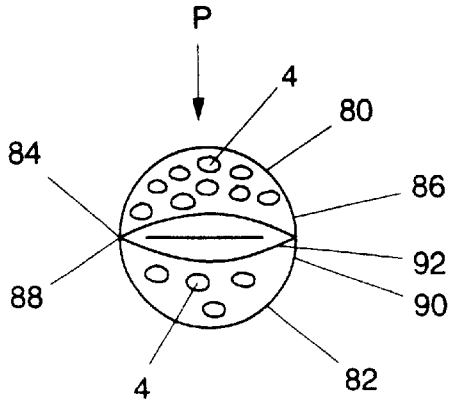

FIG. 9*a* is a first perspective view of a fifth embodiment of a supporting device according to the invention;

FIG. 9*b* is a second view of the fifth embodiment of a supporting device according to the invention;

FIG. 10*a* is a top plan view of a sixth embodiment of a supporting device in the form of a sling according to the invention; and FIG. 10*b* shows a section of the supporting device according to FIG. 10*a*.

Figure 1:
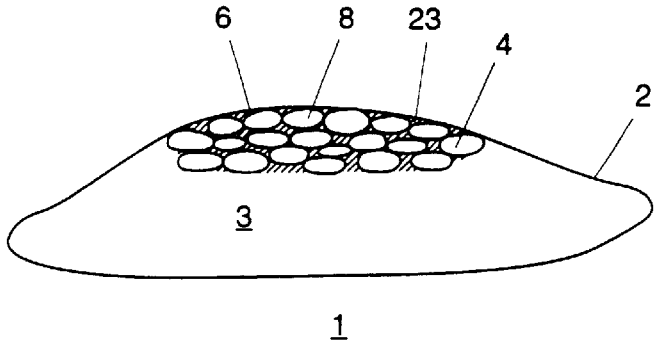

In FIG. 1, by reference numeral 1, a first possible embodiment of a supporting device according to the invention is shown. The supporting device 1 comprises a flexible envelope 2 containing a plurality of elements 4. The elements are movable relative to each other in the space 3 surrounded by the envelope 2. Each element 4 consists of a gas-filled, flexible and thin-walled covering 6. The gas is diagrammatically indicated by reference numeral 8. The coverings 6 of the elements 4 are all of a gastight design, so that the elements are elastically compressible for distributing a load over the supporting device 1.

The covering 6 of the elements 4 is manufactured from an at least substantially nonelastic (i.e. at least substantially nonstretchable) and gas-impermeable material. Further, the elements are each filled with the gas 8 for 50 to 98% of their maximum volume. In this case, the maximum volume is defined as the volume of an element 4 created when a maximum amount of gas is present in that element. Because the covering 6 of an element 4 is manufactured from at least substantially nonelastic material, i.e. the material in question cannot stretch, so that an element cannot be inflated as in the case of a balloon, the maximum volume is well-defined. However, the elements are not filled with a maximum amount of gas that they could comprise. This involves that the elements themselves are deformable, i.e. the shape of the elements can change under the influence of a force or a pressure. On the other hand, it is not possible to flatten the elements entirely, on account of the fact that the covering of the elements is manufactured from a nonelastic material.

Further, the elements take up a volume of from 10 $cm^3$ to 100 $cm^3$. The avantage which the elements having such a volume involve is that the overall outside surface of all elements is less when compared with the same supporting device having smaller elements. This means that the elements are readily slidable relative to each other. After all, if the elements had a much smaller volume, for instance one-tenth $cm^3$, a cushion filled with such elements would behave like a sandbag or a beanbag filled with polystyrene granules. A sandbag has a drawback that it deforms under high load only, whereas a beanbag filled with polystyrene granules has as a drawback that it deforms under low or highly local load only.

On the other hand however, elements which, in accordance with the invention, have a volume of from 10 to 100 $cm^3$, would, if they are not deformable in this utilization, such as for instance ping-pong balls, entail the drawback that a user is provided with a highly uncomfortable supporting device.

In view of the above-mentioned degree of filling of from 50 to 98% of the elements, the supporting device according to the invention provides a solution to this problem. If the volume of the elements were greater than 100 $cm^3$, the elements would possibly be slidable relative to each other even more easily. However, a drawback would be that in that case, a supporting device as a whole would become too thick.

The above-mentioned degree of filling and the associated volume according to the invention involve only the advantages mentioned, while all drawbacks mentioned are eliminated.

Preferably, the elements are filled with the gas for between 75 and 85% of their maximum volume. In particular, the volume of the elements is between 35 $cm^3$ and 45 $cm^3$. The gas with which the elements are filled is preferably a nonflammable gas such as, for instance, air.

An additional advantage of the supporting device according to the invention is that it has a relatively low weight. In comparison with an air cushion which also has a low weight, however, the advantage is achieved that the supporting device according to the invention is highly stable. A user sitting on a supporting device in the form of a cushion will not tend to tilt or slide from the cushion. Another advantage of the supporting device according to the invention is that it cannot become leaky in embodiments wherein the envelope consists of textile.

Figure 2A:
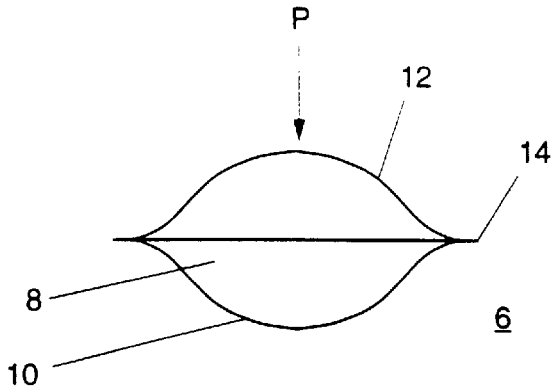
Figure 2B:
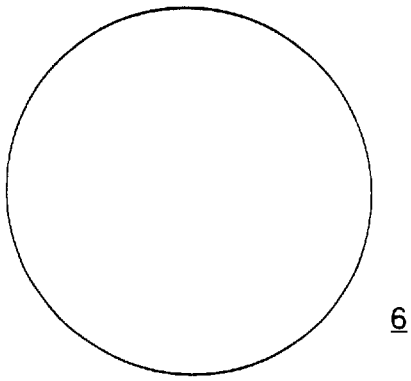

FIG. 2*a* shows a section of an element 6. FIG. 2*b* is a top plan view of an element in the direction of the arrow P according to FIG. 2*a*. The elements have a shape which approaches the spherical shape. In the exemplary embodiment shown of FIG. 2, the element 6 is composed of two sheets of film material 10, 12, each having a circular longitudinal edge 14. The two sheets are sealed together adjacent the longitudinal edges 14. The elements can of course also have a different shape such as a tetrahedral shape.

Figure 3:
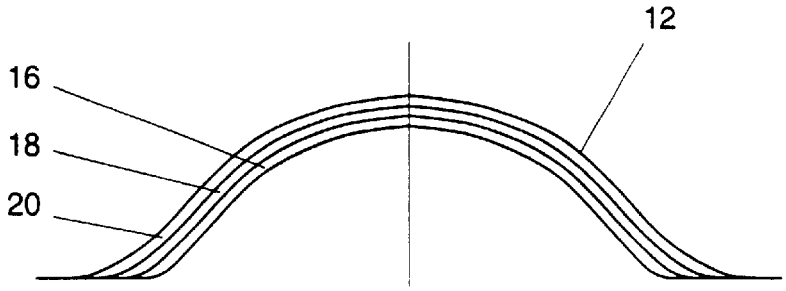
FIG. 3 is a diagrammatical section of a part of the element of the supporting device according to FIG. 1.

FIG. 3 shows, in a diagrammatical manner, the structure of the film from which the sheet 12 of FIG. 2*a* is manufactured. The sheet 12 (as well as the sheet 10) is composed of several layers. The sheet comprises a heat-sealable inner layer 16 to enable processing by means of simple machines at a sufficient production rate. Preferably, the heat-sealable inner layer consists of PE, (V)LDPE, EVA of EMA. Further, the sheet 10, 12 comprises an intermediate layer in the form of a barrier layer 18, which enables exertion for a long period, from months to years, of a force or pressure on the individual elements in conformity with the situation when someone sits or lies down on a cushion or a mattress filled with such elements. Hence, the barrier layer 18 also has the property of being almost impermeable to a gas, such as for instance air. Preferably, the intermediate layer 18 has a maximum OTR (oxygen transmission rate) of 30 at 75% air humidity. In particular, the intermediate layer 18 then consists of EVOH or PVDC.

Finally, the sheet 10, 12 comprises an outer layer which is wear-resistant and provides a low friction coefficient of the elements relative to each other. As outer layer, a nylon fabric or an embossed polyamide film is preferably used. Such a surface structure has as an advantage that the so-called stick-slip effect is prevented. Thus, initial friction forces between the elements relative to each other is limited. Apart from a nylon fabric as outer layer, the use of a friction-reducing coating as part of the outer layer, whether or not in combination with a nylon fabric or a special embossing, is also possible.

In this connection, for instance a silicone coating is the first to be considered. Also, in accordance with the invention, a DLC (diamond-like carbon) coating can be used. The relevant coating is provided on the outer layer 20 of the sheet 10, 12. The element manufactured from the film according to FIG. 3 has a high resistance to frequent deformation (flex/crack resistance). Moreover, this element is completely free from stretch, in other words it is nonelastic. Another advantage is that the relevant type of element is almost entirely gastight, so that the elements will still be filled with practically the same amount of gas even after many years of use. A sheet 10, 12 according to FIG. 3 can be maufactured in a manner known per se by means of a co-extrusion process.

In particular, the supporting device 1 according to FIG. 1 further comprises a lubricant which is located within the envelope 1 but outside the elements 4. The lubricant promotes easy movement of the elements 4 along each other. When the supporting device of FIG. 1 is used as a seat cushion, this involves the advantage that, in use, the elements 4 are capable of repositioning relative to each other in such a manner that the supporting device 1 adapts itself to the body contours of a user. As the elements 4 themselves are also deformable to a certain extent, the adaptation to the contours is even further improved and, moreover, a high sitting comfort is obtained. The stability of the supporting device is then also guaranteed. As a lubricant, for instance a gel can be used. It is also possible to use a powdered lubricant.

If a lubricant is utilized, the outer layer 20 may consist of PE, (V)LDPE, EVA or EMA, apart from the materials referred to hereinabove in relation to the outer layer. In combination with a lubricant such as for instance silicone oil, such materials provide an optimum movability of the elements relative to each other, i.e. a very low friction coefficient between the elements relative to each other.

Figure 4:
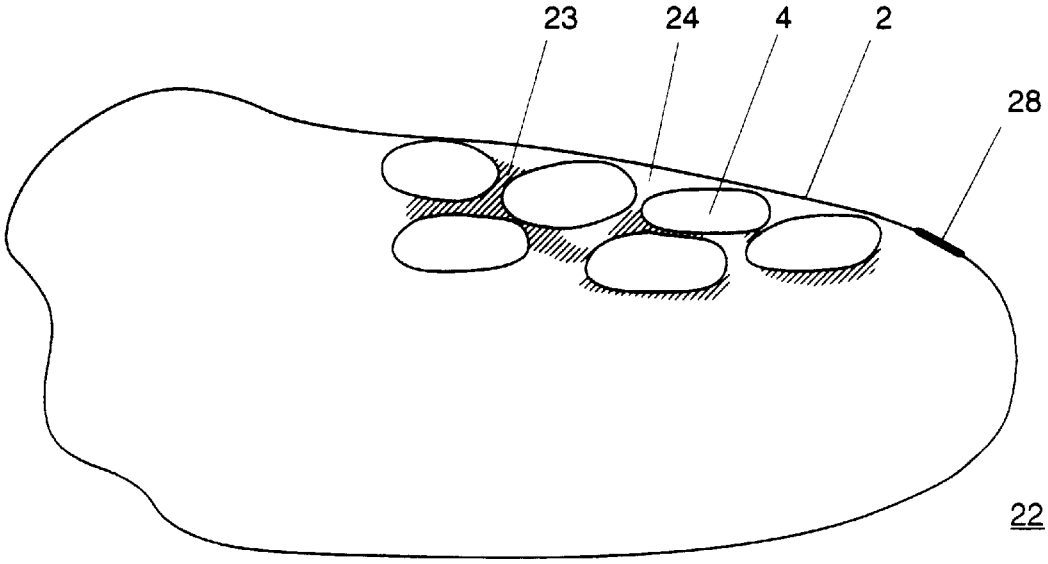
FIG. 4 shows a second embodiment of a supporting device according to the invention.

FIG. 4 shows an alternative embodiment according to the invention, wherein parts corresponding to FIG. 1 have been provided with the same reference numerals. The supporting device 22 of FIG. 4 comprises an envelope 2 wherein a number of gas-filled elements 4 are included. The gas-filled elements 4 can for instance have the same properties as described in relation to the elements according to FIGS. 1–3. Moreover, between the elements 4 of the supporting device of FIG. 4, a lubricant 23 is present as is discussed in relation to FIG. 1. Both to the envelope of FIG. 1 and to the envelope of FIG. 4, it applies that if a lubricant 22 is used, these envelopes should oe impermeable to the lubricant.

However, the use of a lubricant which reduces to a sufficient extent the friction coefficient between the individual elements requires such a large amount of lubricant that the weight of the supporting device will increase by tens of percents.

In accordance with the invention, this drawback can be overcome by arranging that a specific amount of free air or gas is present outside the elements but within the envelope 2. It is thus provided that the elements are sufficiently movable relative to each other while a minimum amount of lubricant is used. The amount of free air or gas in the envelope moreover contributes to an increase of the form-restoring capacity of the supporting device when the loading on the supporting device is ended.

The volume amount of free air or gas 24 between the elements 4 will preferably be approximately 2 to 20% of the total volume occupied by the elements 4 in combination. This applies to supporting devices of a volume which is for instance greater than 10 $dm^3$. On the other hand, when more air 24 were present in the envelope 2, the supporting device 22 would behave like a common air cushion with the drawback of, inter alia, the associated instability.

According as the total volume of the supporting device 22 increases, the percentage of free air in that volume can increase as well without the supporting device starting to behave like an air cushion. The above involves that precisely such supporting devices permit a great form-restoring capacity.

In the case of smaller supporting devices (for instance smaller than 4 $dm^3$), such as for instance pillows, the margin for the volume of the free air between the elements is only slight. This would mean that only a slight form-restoring capacity is feasible.

In accordance with a specific embodiment of the supporting device, this drawback is overcome in that the supporting device comprises means for decreasing the amount of gas in the space in the case of a load on the supporting device and for increasing the amount of gas upon the removal of a load on the supporting device without involving a variation of the amount of lubricant in the space. Decreasing the amount of air means that a more stable cushion is obtained. By subsequently increasing the amount of air, the form-restoring capacity is promoted.

A particular embodiment of this is also shown in FIG. 4. In this embodiment, the above-mentioned gas 24 consists of air and the envelope 2 comprises a diaphragm 28 which is known per se and which enables the passage of air from the inside out of and from the outside into the envelope 2, whilst the diaphragm 28 is impermeable to the lubricant 24. The diaphragm 28 moreover has the property of preventing the suction of dust from the outside to the inside. In particular in situations where the supporting device 22 is used under a changing atmospheric pressure, such as is for instance the case in a plane the use of the diaphragm 28 will moreover involve the advantage that at all times, no pressure difference is present between the inside and the outside of the envelope 2, so that the supporting device 22 has the properties desired for a user as described hereinabove.

Figure 5:
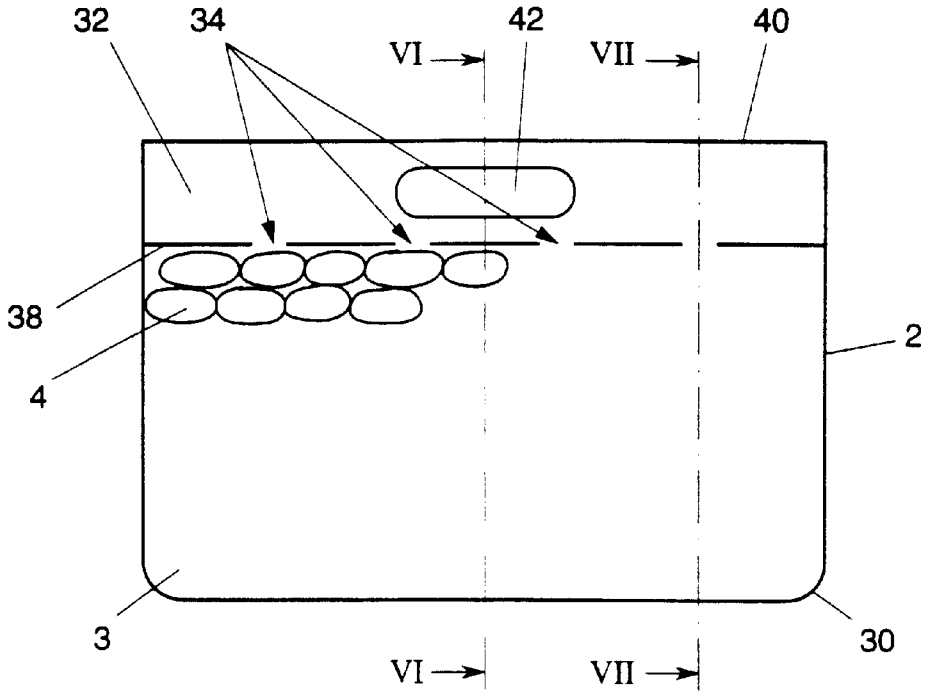
FIG. 5 shows a third embodiment of a supporting device according to the invention.
Figure 6:
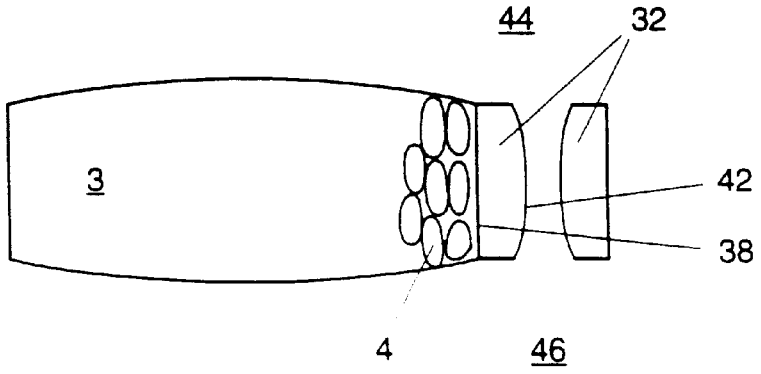
FIG. 6 shows a first section of the supporting device according to FIG. 5.
Figure 7:
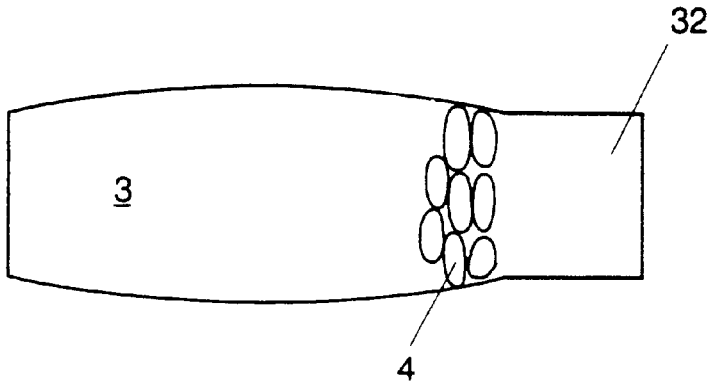
FIG. 7 shows a second section of the supporting device according to FIG. 5.

An alternative embodiment of a supporting device 30 is shown in FIGS. 5–7. The supporting device 30 also comprises means for decreasing the amount of gas in the space when the supporting device is loaded and for increasing the amount of gas when a load on the supporting device is removed. For this purpose, the supporting device 30 comprises a buffer reservoir 32 connected by means of a number of passages 34 to the space 3 wherein the elements 4 are located. The passages 34 have dimensions such that the elements 4 cannot move from the space 3 to the buffer reservoir 32 via these passages 34. When the supporting device 30 is loaded, the buffer reservoir 32 can, via the passages 34, fill with gas coming from the space 3. This gas can flow back again from the reservoir 32 to the space 3 via the passages 34 when the load on the supporting device 30 is removed again. In the present example, the buffer reservoir 32 and the space 3 are separated by means of an intermediate wall 38 provided with the above-mentioned openings 34. Preferably, the intermediate wall 38 is manufactured from the same material as the envelope 2.

Preferably, the buffer reservoir extends adjacent and along an edge 40 of the supporting device 30, as shown in FIG. 5, and is of a ring-shaped design. At the center of the ring, an open passage 42 is present extending from a first outer side 44 to a second outer side 46 of the supporting device 30. The passage 42 can act as a handgrip for carrying the supporting device 30. Of course, the buffer reservoir 32 is sealed from the outside world in an entirely airtight manner. The same applies to the space 3.

The embodiments of the supporting device outlined in FIGS. 4–7 will all be capable of experiencing a change of volume contents under a slight load. In particular, the envelope is for this purpose manufactured from a material which transmits the forces in an undeformed manner. In this connection, it is important that in the envelope as little tension as possible can be created in the surface when loaded. For the envelope, it is preferred to use a material which is stretchable in two directions and which has an elasticity in the order of the elasticity of the human skin. The greatest degree of elasticity should be provided in a transverse direction of the supporting device.

Figure 8:
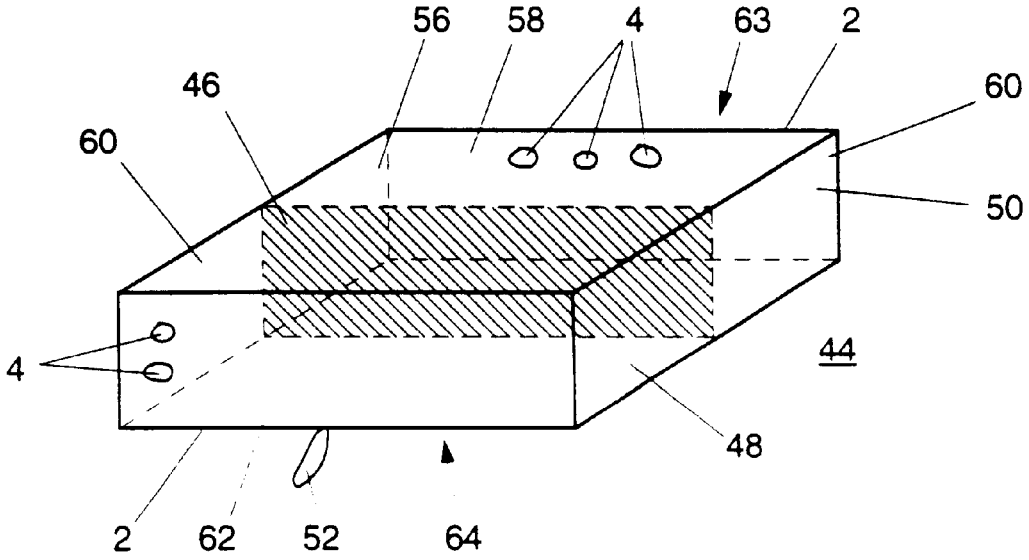
FIG. 8 is, in perspective, a transparent view of a fourth embodiment of a supporting device according to the invention.

FIG. 8 shows a particular embodiment of a supporting device 44 of a type as described in one of the preceding Figures. In particular, the supporting device 44 is provided, in the inner space of the envelope 2, with a partition 46 dividing this space into a first and a second subspace 48, 50. In particular, in the first and the second subspace, per volume unit thereof, a different number of elements 4 are present, only a few of which are shown in the Figure. The partition 46 prevents a displacement of the elements 4 from the first 48 to the second 50 subspace and vice versa. In particular, the partition can also prevent the displacement of a lubricant, if present, from the first to the second subspace and vice versa. The same applies to a gas which may be present between the elements 4. However, it is also possible that the partition 46 does not form a barrier to gas and the lubricant, if present.

The advantage of a difference in degree of filling of the first and the second subspace 48, 50 with elements 4 is that a so-called wedge action is introduced. In particular cases, for instance when the supporting device 44 is used as a wheelchair cushion, this may involve an improvement in the sitting position. For instance, the first subspace 48 may have a higher degree of filling than the second subspace 50. If the second subspace 50 is placed adjacent the back support of the wheelchair, this will have as a result that a user tilts in the direction of the back support and the tendency to slip is thereby prevented.

Because through the use of the partition 46, an asymmetrical supporting device 44 is created, it is important for an optimum action that an outer cover is fitted correctly over an inner cover, in this case the envelope 2, and that the supporting device, including the outer cover, is then placed in a correct manner in, for instance, the wheelchair. For this purpose, the envelope 2 is at its outside provided with a wire-shaped loop 52.

FIG. 9*a* shows in which manner the envelope 2 of FIG. 8 is placed in an outer cover 54. As the supporting device 44 in this example forms a rectangular or square cushion having four upright sidewalls 56–62, a top surface 63 and a bottom surface 64, while the loop 52 is located at a position off the center of each of the sidewalls, top surface and bottom surface, the envelope 2 can be received into the outer cover 54 in an unequivocal manner only, in such a manner that it is possible to have the loop 52 project outwards through an opening 66 in the outer cover 54. For this purpose, the opening 66 is provided at a position corresponding to the position of the loop 52. It is essential that the loop 52 is located at a position which does not lie on the axis of symmetry of the supporting device 44.

Hence, the supporting device shown in FIG. 9*a*, comprising the outer cover 54 and the filled envelope 2 included therein, has as an advantage that it is precisely known in what manner the envelope 2 is included in the outer cover 54. Now, it is also possible to place the supporting device 44 according to FIG. 9*a* in a chair in a correct manner. For instance, it can be arranged that the loop 52 should be located on the side of a chair facing away from the back support. Further, it can be arranged that the loop 52 marks the bottom side of the supporting device.

FIG. 9*b* shows the supporting device of FIG. 9*a*, viewed from a direction indicated by the arrow P in FIG. 9*a*. From this it appears that two corner points 67, 68 formed by three upright sidewalls and in this case the bottom surface 64 are each provided with a visually or tangibly recognizable marking, in this example indicated in hatched lines. This has as an advantage that in use, a proper positioning of the supporting device in, for instance, a wheelchair can take place in an easy manner. In this case, it can for instance be arranged that the corner points 67, 68 should be placed adjacent the support and the seat bottom of a chair.

Finally, FIGS. 10*a* and 10*b* show a particular embodiment of lifting or hoisting belt wherein a supporting device 70 is used of the type as described in one of the preceding FIGS. 1-9. In this example, the lifting or hoisting belt 72 consists of two metal clasps 74,76, interconnected by means of a belt 78. The belt 78 can for instance be tied around a person in order to lift that person. In this connection, one may think of, inter alia, lifting installations used in a hospital, but also of lifting installations used in, for instance, a helicopter. A lifting or hoisting belt known per se consists of a fabic-reinforced, air-inflated hose (fire hose), which, however, has as a drawback that it may cause injuries, bruises and pressure spots on a person. Therefore, in accordance with the invention, the belt 78 is surrounded by a supporting device 70. In this example, the supporting device 70 consists of two envelopes 80, 82, each filled with elements 4. The envelopes 80, 82 each extend in the longitudinal direction of the belt 78. The longitudinal edges 84, 86 of the envelope 80 are attached to the longitudinal edges 88, 90 of envelope 82; the arrangement being such that the supporting devices 80, 82 in combination form a space 92 in the longitudinal direction of which the belt 78 extends. This means that a supporting device 72 is formed in the form of a lifting or hoisting belt 72 having the property that during the lifting movement, the pressure is distributed more evenly over the body without the possible occurrence of the above-mentioned complications. Moreover, there is only a tensile stress in the belt 78, while the supporting devices 80, 82 substantially exert a force perpendicular to the body. Hence, the lifting or hoisting belt comprises a strip-shaped belt 78 which is enveloped through at least a portion of its length by at least a supporting device 80, 82.

For the sake of completeness, it is observed that the invention is by no means limited to the embodiments described hereinabove. For instance, it is possible to construct a supporting device in the form of a life jacket having all above-mentioned advantages. After all, the gas-filled elements will provide a sufficient floating power of the life jacket.

It will also be understood that the elements 4, having the specific property as is described in relation to FIG. 1, can also be used in the supporting devices described with reference to the other Figures. These and other variants are all understood to fall within the scope of the invention.

We claim:

1. A supporting device comprising a space formed by a flexible envelope and filled with a plurality of elements, the elements in the space being movable relative to each other and each consisting of a gas-filled, flexible and thin-walled covering of gastight design, so that the elements are deformable for distributing a load over the supporting device, characterized in that the covering of a number of elements is manufactured from material which is at least substantially nonelastic and non-stretchable at ambient temperature of use and under user's body weight so a maximum volume of each of said elements is well defined, each of said elements being filled with the gas for 50–98 percent of its maximum volume and having a volume of from 10 $cm^3$ to 100 $cm^3$.

2. A supporting device according to claim 1, characterized in that each element of at least substantially all elements is filled with the gas for 50–98 percent of its maximum volume and has a volume of from 10 $cm^3$ to 100 $cm^3$.

3. A supporting device according to claim 1, characterized in that the elements are filled with the gas preferably for between 75 to 85 percent of their maximum volume.

4. A supporting device according to claim 1, characterized in that the volume of the elements is preferably between 35 $cm^3$ and 45 $cm^3$.

5. A supporting device comprising a space formed by a flexible envelope and filled with a plurality of elements, the elements in the space being movable relative to each other and each consisting of a gas-filled, flexible and thin-walled covering of gastight design, so that the elements are deformable for distributing a load over the supporting device, characterized in that the covering of a number of elements is manufactured from at least substantially nonelastic material, each of said elements being filled with the gas for 50–98 percent of its maximum volume and having a volume of from 10 $cm^3$ to 100 $cm^3$, and further characterized in that the thin-walled covering of an element comprises a heat-sealable inner layer, a wear-resistant outer layer having a relatively low friction coefficient relative to the material itself and the inner side of the envelope, and at least one intermediate layer which is at least substantially impermeable to said gas.

6. A supporting device according to claim 5, characterized in that the inner layer consists of polyethylene, very low density polyethylene, ethylene vinyl acetate or ethylene methyl acetate.

7. A supporting device according to claim 5, characterized in that the intermediate layer has a maximum OTR (oxygen transmission rate) of 30 to 75% air humidity.

8. A supporting device according to claim 7, characterized in that the intermediate layer consists of ethylene vinyl alcohol polymer or polyvinylidene chloride.

9. A supporting device according to claim 5 characterized in that the outer layer comprises a nylon fabric or an embossed polyamide film.

10. A supporting device according to claim 5, characterized in that the outer layer comprises a silicone coating or a diamond-like carbon coating.

11. A supporting device according to claim 1, characterized in that in the envelope, between the elements, a lubricant is present for facilitating a movement of the elements relative to each other, caused by a load on the supporting device.

12. A supporting device according to claim 11, characterized in that the outer layer consists of polyethylene, very low density polyethylene, ethylene vinyl acetate or ethylene methyl acetate.

13. A supporting device comprising a space formed by a flexible envelope and filled with a plurality of elements, the elements in the space being movable relative to each other and each consisting of a gas-filled, flexible and thin-walled covering of gastight design, so that the elements are deformable for distributing a load over the supporting device, a lubricant being present in the space between the elements for facilitating a redistribution of the elements in the space through relative movement in the envelope in reaction to a load on the supporting device, and the envelope being impermeable to the lubricant, characterized in that the covering of a number of elements is manufactured from material which is at least substantially nonelastic and non-stretchable at ambient temperature of use and under a user's body weight so a maximum volume of each of said elements is well defined, and in that a free amount of gas is present in the space between the elements, allowing a minimum amount of lubricant to be present, whilst the gas facilitates a form restoration of the supporting device after the removal of a load on the supporting device.

14. A supporting device according to claim 13, characterized in that the supporting device comprises means for decreasing the amount of gas in the space when the supporting device is loaded and for increasing the amount of gas upon the removal of a load on the supporting device without invloving a variation of the amount of lubricant in the supporting device.

15. A supporting device according to claim 14, characterized in that said gas consists of air, the envelope comprising a diaphragm enabling the passage of air from the inside out of and from the outside into the envelope, the diaphragm being impermeable to the lubricant.

16. A supporting device according to claim 14, characterized in that the supporting device further comprises a buffer reservoir connected, by means of at least one passage, to the space wherein the elements are located, whilst the passage has dimensions such that the elements cannot move via the passage from the space to the buffer reservoir, and when the supporting device is loaded, the buffer reservoir can fill, via the passage, with gas coming from the space, whcich gas can flow back to the space when the load is removed.

17. A supporting device according claim to 16, characterized in that the buffer reservoir extends adjacent an edge of the supporting device and is of a ring-shaped design, whilst via the center of the ring an open passage is present from a first outer side of the supporting device to a second outer side of the supporting device, which passage can act as a handgrip for carrying the suppoprting device.

18. A supporting device according to claim 13, characterized in that the covering of a number of elements is manufactured from at least substantially nonelastic material, each of said elements being filled for 50–98 percent of its maximum volume with the gas and having a volume of from 10 $cm^3$ to 100 $cm^3$.

19. A supporting device according to claim 13, characterized in that in the space a partition is present dividing the space into a first and a second subspace.

20. A supporting device according to claim 19, characterized in that in the first and the second subspace, per volume unit, a mutually different number of elements is present and the partition preventing a displacement of the elements from the first to the second subspace and vice versa.

21. A supporting device according claim 19, characterized in that the supporting device further comprises an outer cover wherein the envelope is received, the envelope comprising a loop projecting outwards through an opening in the outer cover.

22. A supporting device according to claim 21, characterized in that the loop and the opening have a position such that the envelope can take up only one position in the outer cover, with the loop projecting outwards through the opening.

* * * * *